US006933431B2

(12) United States Patent
Muramatsu

(10) Patent No.: US 6,933,431 B2
(45) Date of Patent: Aug. 23, 2005

(54) PERFORMANCE DEVICE OF MUSIC BOX OR THE LIKE TYPE

(75) Inventor: Shigeru Muramatsu, Mori-machi (JP)

(73) Assignee: Yamaha Corporation, Shizuoka-ken (JP)

( * ) Notice: Subject to any disclaimer, the term of this patent is extended or adjusted under 35 U.S.C. 154(b) by 322 days.

(21) Appl. No.: 10/402,955

(22) Filed: Apr. 1, 2003

(65) Prior Publication Data

US 2003/0183063 A1 Oct. 2, 2003

(30) Foreign Application Priority Data

Apr. 2, 2002 (JP) ..... 2002-099831

(51) Int. Cl.[7] ..... G10H 7/00

(52) U.S. Cl. ..... 84/600; 84/94.1; 446/265; 446/397

(58) Field of Search ..... 84/600, 94–94.2, 84/95.1–95.2, 402; 446/265, 297–298, 303, 397

(56) References Cited

U.S. PATENT DOCUMENTS 4,466,328 A 8/1984 Kitamura
5,422,429 A * 6/1995 Shih et al. ..... 84/94.2
5,696,333 A * 12/1997 Shih ..... 84/95.2
5,962,796 A 10/1999 Nakamura et al.
6,538,186 B1 * 3/2003 Huang ..... 84/453
6,858,789 B2 * 2/2005 Muramatsu et al. ..... 84/600
2003/0150316 A1 * 8/2003 Muramatsu ..... 84/94.1
2003/0167905 A1 * 9/2003 Muramatsu et al. ..... 84/610

* cited by examiner

*Primary Examiner*—Marlon T. Fletcher
(74) *Attorney, Agent, or Firm*—Dickstein, Shapiro, Morin & Oshinsky, LLP.

(57) ABSTRACT

Each of a plurality of TG (tone generation) units includes a plurality of TG elements corresponding to a plurality of tone pitches. A plurality of resonant boxes are provided in corresponding relation to the TG units, and each box is formed of a material having a characteristic different from the materials forming the other boxes. One or more of the TG elements to be driven for tone generation are determined on the basis of tone pitch designating information and tone color setting information, and the determined TG elements are driven to vibrate. Because the resonant boxes are formed of different materials, tones can be generated with peculiar tone colors in accordance with the materials of the resonant boxes corresponding to the vibrated TG elements. In an alternative, the TG elements in each of the TG units may be formed of a material of a characteristic different from materials forming the TG elements of the other TG units.

7 Claims, 10 Drawing Sheets

| | |
|---|---|
| KEY-ON/OFF | KEY No. |
| VELOCITY | |
| DELTA TIME | |
| KEY-ON/OFF | KEY No. |
| VELOCITY | |
| KEY-ON/OFF | KEY No. |
| VELOCITY | |
| KEY-ON/OFF | KEY No. |
| VELOCITY | |
| DELTA TIME | |
| KEY-ON/OFF | KEY No. |
| VELOCITY | |

| KEY NO. | TONE COLOR SETTING | SOLENOID |
|---|---|---|
| 48 | 1 | A1 |
| 49 | 1 | A2 |
| 50 | 1 | A3 |
| ⋮ | ⋮ | ⋮ |
| ⋮ | ⋮ | ⋮ |
| ⋮ | ⋮ | ⋮ |
| 48 | 2 | B1 |
| 49 | 2 | B2 |
| 50 | 2 | B3 |
| ⋮ | ⋮ | ⋮ |
| ⋮ | ⋮ | ⋮ |
| ⋮ | ⋮ | ⋮ |
| 48 | 3 | C1 |
| 49 | 3 | C2 |
| 50 | 3 | C3 |
| ⋮ | ⋮ | ⋮ |
| ⋮ | ⋮ | ⋮ |
| ⋮ | ⋮ | ⋮ |
| 48 | 4 | D1 |
| 49 | 4 | D2 |
| 50 | 4 | D3 |
| ⋮ | ⋮ | ⋮ |
| ⋮ | ⋮ | ⋮ |
| ⋮ | ⋮ | ⋮ |

FIG. 8

PERFORMANCE DEVICE OF MUSIC BOX OR THE LIKE TYPE

BACKGROUND OF THE INVENTION

The present invention relates generally to music performance devices, such as music boxes, and more particularly to an improved music performance device which is capable of setting desired tone colors.

As well known, music performance devices, such as music boxes, include a scale plate (tone generator) having a plurality of reeds or thin vibrating pieces. Generally, such performance devices perform a music piece by the vibrating pieces being selectively picked or plucked via a vibrating-piece drive means, such as protruding pins of a rotating drum or star-shaped wheels, disposed in corresponding relation to the vibrating pieces. Tones thus generated from the scale plate are transmitted to a vibrating plate coupled to the scale plate or a casing of the music box, upon which the vibrating plate or casing is caused to vibrate and resonate so that the tones can be uttered with ample tone colors. In recent years, there has been known another type of music box, where the vibrating-piece drive means comprises electromagnetic solenoids or the like and the vibrating pieces are selectively picked or plucked by the vibrating-piece drive means being electrically activated in a controlled manner. With such conventionally known music boxes, however, there can be generated only tones of fixed or invariable tone quality and volume corresponding to the materials and sizes of the casing, vibrating plate and various other component parts; that is, the tone color can not be set or changed as desired by a user.

Also known is a music box, where a transmission means in the form of a resilient member is provided between the casing retaining the scale plate and the vibrating plate and where the resilient member has a slanted surface abutting against the casing and vibrating plate. Here, the abutting area of the slanted surface against the casing and vibrating plate is variable by changing pressure with which the slanted surface abuts against (i.e., is pressed against) the casing and vibrating plate, so that the tone volume and quality can be adjusted in accordance with a variation in the abutting area. However, this music box, including a single scale plate and a single vibrating plate, can only generate tones with invariable tone generating characteristics of the single scale plate and single vibrating plate alone, which would unavoidably lead to poor variation in tone quality (tone color). Although there has been known still another type of music box that permits tone volume adjustment by controlling an opening angle of an upper lid of the casing accommodating the tone generator, no tone quality (tone color) variation can be obtained by just adjusting the amount of tone emission through the opening formed by the upper lid.

SUMMARY OF THE INVENTION

In view of the foregoing, it is an object of the present invention to provide a performance device of a music box or the like type which is capable of generating tones with a variety of tone colors.

In order to accomplish the above-mentioned object, the present invention provides a performance device which comprises: a plurality of tone generation units, each of the tone generation units including a plurality of tone generating elements corresponding to a plurality of tone pitches; a plurality of resonant boxes provided in corresponding relation to the tone generation units, each of the resonant boxes being formed of a material having a characteristic different from materials forming the other resonant boxes; a drive mechanism that mechanically drives and thereby vibrates the tone generating elements; and a control section that determines any of the tone generating elements to be driven for tone generation on the basis of tone pitch designating information and tone color setting information and controls the drive mechanism to drive the determined tone generating element.

In the present invention, the resonant boxes are formed of different materials. Thus, by only selecting an appropriate one of the tone generation units such that the resonant box corresponding to a tone color set by tone color setting information is used for tone generation, there can be generated a tone with peculiar tone generating characteristics corresponding to the material of the resonant box used. With the arrangement, the performance device of the present invention can generate tones with a wide variety of tone colors corresponding to the different characteristics of the plurality of resonant boxes.

According to another aspect of the present invention, there is provided a performance device, which comprises: a plurality of tone generation units, each of the tone generation units including a plurality of tone generating elements corresponding to a plurality of tone pitches, the tone generating elements in each of the tone generation units being formed of a material having a characteristic different from materials forming the tone generating elements of the other tone generation units; a resonant box that resonantly vibrates in response to vibrations produced on the tone generation units; a drive mechanism that mechanically drives and thereby vibrates the tone generating elements; and a control section that determines any of the tone generating elements to be driven from among the plurality of tone generation units on the basis of tone pitch designating information and tone color setting information and controls the drive mechanism to drive the determined tone generating element. In the present invention, the tone generation units are formed of different materials. Thus, by selecting an appropriate one of the tone generation units on the basis of tone color setting information, there can be generated a tone with peculiar tone generating characteristics corresponding to the material of the selected tone generation unit. With the arrangement, the present invention can generate tones with a wide variety of tone colors corresponding to the different characteristics of the tone generation units.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 8 is a diagram showing an example of an actuator determining table to be used for determining an actuator to be driven in the music box;

DETAILED DESCRIPTION OF THE EMBODIMENTS

Now, a description will be given about a music box, constructed as an embodiment of a performance device of the present invention, which includes a tone generator in the form of a scale plate having a plurality of reeds (thin vibrating pieces) that generate scale tones by being picked or plucked.

Figure 1:
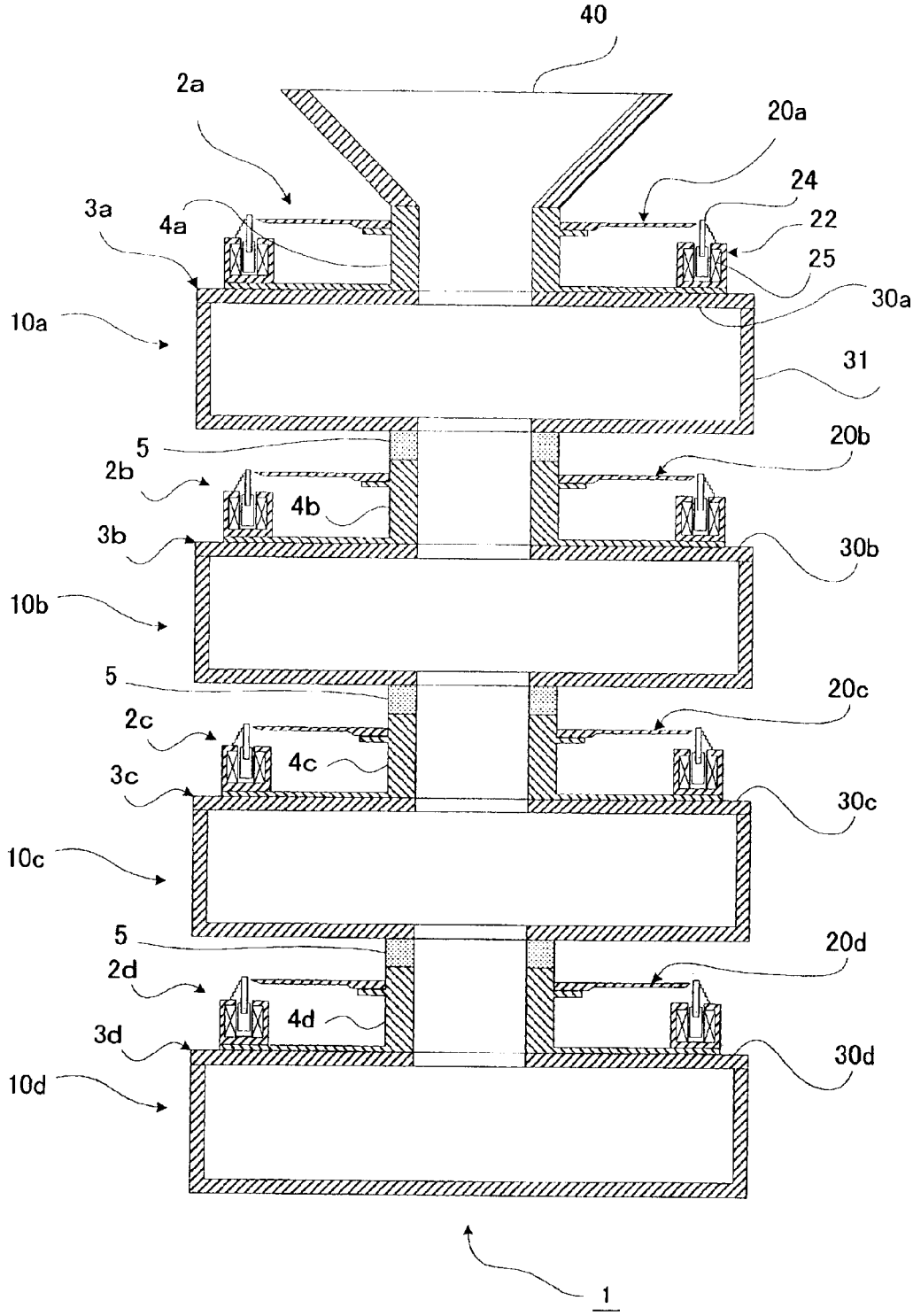
FIG. 1 is a sectional view showing a music box in accordance with an embodiment of the present invention.
Figure 2:
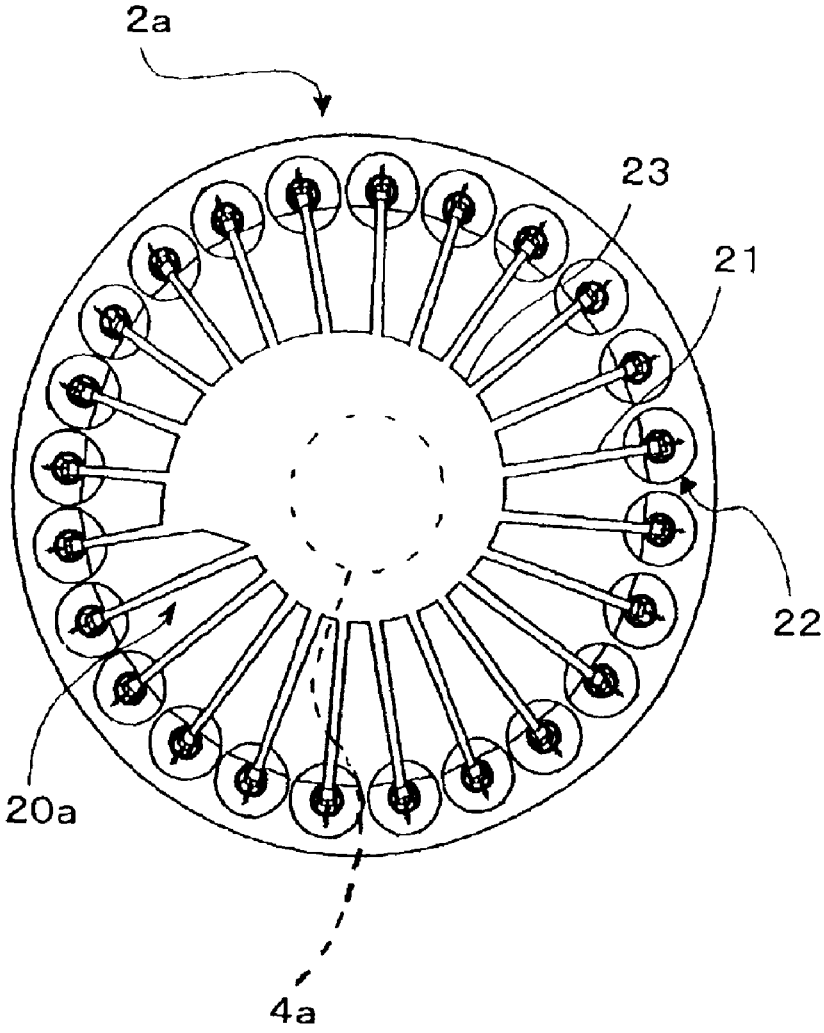
FIG. 2 is a plan view of a tone generation mechanism of the music box.

FIG. 1 is a schematic sectional view of a music box in accordance with a first embodiment of the present invention, and FIG. 2 is a fragmentary plan view showing a tone generation mechanism of the music box of FIG. 1. The music box 1 comprises a plurality of (four in the illustrated example) tone generation units 10*a*–10*d*, which include respective tone generation mechanisms 2*a*–2*d* and respective resonant boxes 3*a*–3*d* that resonate with vibrations of tones generated by the corresponding tone generation mechanisms 2*a*–2*d* to thereby physically reinforce the tones. In FIG. 1, the tone generation units 10*a*–10*d* are arranged vertically in a plurality of tiers (four tiers in the illustrated example). Connection assisting members 5 are interposed between adjacent tone generation units 10*a*–10*d* (between the units 10*a* and 10*b*, 10*b* and 10*c*, and so on); that is, every adjacent tone generation units 10*a*–10*d* are interconnected by the connection assisting member 5. As will be later detailed, the tone generation units 10*a*–10*d* in the instant embodiment have respective vibrating plates (sounding plates) formed of different materials having different characteristics so that each of the tone generation units 10*a*–10*d* exhibits peculiar tone generating characteristics different from those of the other tone generation units.

The tone generation units 10*a*–10*d* are generally similar in basic construction, and this and following paragraphs representatively describe the tone generation unit 10*a*. The tone generation mechanism 2*a* includes a scale plate (or reed section) 20*a* having a plurality of reeds (tone generating elements) 21, and reed driving units 22 provided in corresponding relation to the reeds 21. These scale plate 20*a* and reed driving units 22 are held by a central support section 4*a*, and vibrations produced by the scale plate 20*a* are first transmitted to the support section 4*a*. The support section 4*a* is disposed on the upper surface of the resonant box 3*a*, and the vibrations transmitted to the support section 4*a* are delivered to the resonant box 3*a* by way of an abutting portion located between the support section 4*a* and the resonant box 3*a*.

As shown in FIG. 2, the scale plate 20*a* is secured at its proximal end 23 to the central support section 4*a*. The plurality of reeds 21, which are provided in corresponding relation a plurality of scale notes (tone pitches) over a predetermined pitch range, extend radially from the proximal end 23 of the scale plate 20*a* toward the outer circumferential periphery of the scale plate 20*a*. Dimensions, such as a length and width, of each of the reeds 21 are set appropriately in accordance with the scale note (tone pitch) assigned to that reed 21. Each of the reed driving units 22, provided in corresponding relation to the reeds 21, includes a pick member 24 for mechanically driving (i.e., picking or plucking) the corresponding reed 21, and an actuator 25 operatively coupled with the pick member 24. For example, the actuator 25 is in the form of an electromagnetic solenoid having a plunger movable in a vertical direction. The pick member 24 is driven, by the vertical movement of the plunger of the corresponding actuator 25, to pick and vibrate the corresponding reed 21.

The resonant box 3 includes a vibrating plate (sounding plate) 30*a* constituting an upper surface portion of the resonant box 3, and a frame 31 supporting thereon the vibrating plate 30*a*. Box-shaped inner resonating space is defined by the vibrating plate 30*a* and frame 31. Vibrations produced on the scale plate 20*a* are transmitted through the central support section 4*a* to the vibrating plate 30*a*, so that the vibrating plate 30*a* vibrates resonantly with the transmitted vibrations. The vibrations of the vibrating plate 30*a* are caused to resonate and are physically reinforced in the resonating space; thus, each tone generated from the music box 1 can be imparted with an ample resonant effect. In this case, resonant characteristics of the vibrating plate 30*a* are determined by characteristics of the material, width, etc. of the vibrating plate 30*a*, and a tone color of a tone generated via the vibrating plate 30*a* is set in accordance with the resonant characteristics of the vibrating plate 30*a*. As will be later described, the material of the reeds (vibrating pieces) 21 also contributes to establishment of the tone color. Note that the frame 31 of the resonant box 3 may be formed of any appropriate rigid material.

Further, the central support section 4*a* is generally in the shape of a hollow cylinder opening at its upper and lower ends, and the vibrating plate 30*a* has an aperture corresponding in position to, and hence communicating with, the lower end opening of the central support section 4*a*. Further, the central support section 4*a* of the tone generation unit 10*a* has a funnel-shaped tone-emitting opening portion (bell or flare) 40 formed at it top. In this manner, the inner resonating space of the resonant box 3 communicates with the tone-emitting opening portion (bell or flare) 40 through the cylindrical hollow space of the support section 4*a*, so that the generated tone is audibly uttered through the tone-emitting opening portion 40 in a dynamically reinforced fashion. As a consequence, a greater tone can be produced from the music box. Note that the provision of the tone-emitting opening portion (bell or flare) 40 may be optional.

Similarly to the tone generation unit 10*a*, the other tone generation units 10*b*–10*d* include tone generation mechanisms 2*b*–2*d* and resonant boxes 3*b*–3*d*. Of every adjacent tone generation units (e.g., units 10*a* and 10*b*) interconnected via the connection assisting member 5, the resonant box (e.g., 3*a*) of the one tone generation unit (e.g., 10*a*) positioned above the other (e.g., 10*b*) also has a lower aperture communicating with the upper end opening of the central support 4*b* of the other or lower tone generation unit (e.g., 10*b*). Therefore, the inner resonating spaces of all the resonant boxes 3*a*–3*d* communicate with the tone-emitting opening portion 40. The connection assisting members 5 interposed between the tone generation units 10*a*–10*d* are each made of, for example, a soft material such as a rubber material capable of absorbing vibrations (i.e., much less capable of transmitting vibrations therethrough), so that each of the connection assisting members 5 can also function as a vibration isolator; that is, the connection assisting members 5 serve to prevent undesired transmission of vibrations between the tone generation units 10*a*–10*d*.

The scale plates 20*b*–20*d* of the other tone generation units 10*b*–10*d* may be constructed in the same manner as the above-described scale plate 20*a* of the tone generation unit 10*a*, so as to generate individual scale notes (tone pitches) within the same pitch range as the scale plate 20*a*. However, in the illustrated example of FIG. 1, each of the vibrating plates 30*a*–30*d* of the resonant boxes 3*a*–3*d* in the tone generation units 10*a*–10*d* is made of a different material from the other vibrating plates; that is, the material of each of the vibrating plates 30*a*–30*d* has different characteristics from the materials forming the other vibrating plates. Thus, the vibrating plates 30*a*–30*d* present different vibration and resonance characteristics according to the materials used, so that the vibration and resonance characteristics of the resonant box differ from one tone generation unit to another. In this way, the tone generation units 10*a*–10*d* can generate tones with their peculiar tone colors. Therefore, by appropriately switching the tone generation unit to be used in accordance with a desired tone color, it is possible to make diversified tone color selections and changes corresponding to the plurality of tone generation units 10*a*–10*d*. Specifically, when a given tone pitch is to be generated, one of the reeds 21, corresponding to the given tone pitch, in any one of the tone generation units 10*a*–10*d* is driven (picked or plucked), so that the tone of the given pitch can be generated with a tone color corresponding to given tone color setting information.

As a specific example, the vibrating plate 30*a* is formed of soft rubber, the vibrating plate 30*b* formed of hard rubber, the vibrating plate 30*c* formed of wood, and the vibrating plate 30*d* formed of metal. Of course, these vibrating plates 30*a*–30*d* may be formed of other appropriate materials than the above-mentioned, as long as the materials differ among the vibrating plates 30*a*–30*d*. In a case where generated tones differ in volume depending on the materials used, overall volume balance may be secured, by, for example, appropriately differentiating the sizes of the vibrating plates, resonant boxes, reeds and/or the like among the tone generation units 10*a*–10*d* in such a manner that the sound volumes of the individual tone generation units are set to respective appropriate levels. Further, irrespective of whether or not the volume of generated tones differ depending on the materials used, the size, shape and/or the like of the resonant boxes 3*a*–3*d* may be differentiated among the tone generation units 10*a*–10*d* to provide not only different tone colors but also different tone volumes from the units 10*a*–10*d*. Alternatively, only the tone volume may be differentiated by choosing different sizes, shapes and/or the like for the resonant boxes 3*a*–3*d* with the vibrating plates 30*a*–30*d* made of the same material (i.e., without differentiating the tone color among the tone generation units 10*a*–10*d*).

Figures 3, 4:
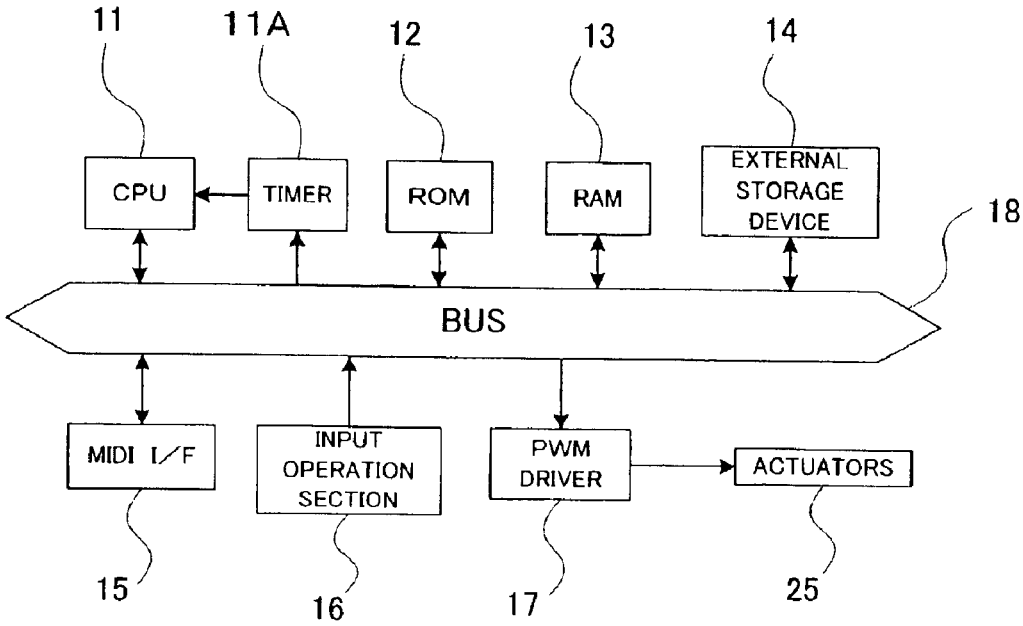
FIG. 3 is a block diagram showing an exemplary hardware setup of a drive control mechanism in the music box.
FIG. 4 is a diagram showing an example format of performance data to be used for an automatic performance by the music box.

Now, a description will be given about performance control performed in the music box 1. FIG. 3 is a block diagram showing an exemplary hardware setup of a control system in the music box 1. As shown, the music box 1 generally comprises a microprocessor unit (CPU) 11 for controlling the entire music box 1, a ROM 12 for storing data and for use as a working memory, a RAM 13 for storing data and for use as a working memory, an external storage device 14, a MIDI interface (I/F) 15, an input operation section 16, a PWM driver 17, and a timer 11A. The above-mentioned components 11, 12, 13, 14, 15, 16, 17 and 11A are interconnected via a data and address bus 18. The timer 11A, which is connected to the CPU 11, counts various times including times to signal interrupt timing for timer interrupt processes. Namely, the timer 1A generates tempo clock pulses for counting time intervals and setting a performance tempo with which to automatically perform a music piece in accordance with given music piece data.

The MIDI interface 15 is an interface for inputting, to the music box 1, MIDI performance data generated by a not-shown MIDI device, such as a keyboard or sequencer, in response to manual performance operation or through automatic performance processing. The external storage device 14 has prestored therein automatic music piece performance data, and a music piece performance can be executed on the basis of the performance data read out from the external storage device 14 into the RAM 13. The ROM 12 or RAM 13 stores an actuator determining table to be used for tone color selection/setting as will be later described, and also includes storage areas for various flags and registers. The PWM driver 17 drives a designated one of the actuators 25. The input operation section 16 includes operators operable to select or set a tone color of a tone to be generated; these operators will hereinafter be referred to as "tone color setting switches".

FIG. 4 shows an example format of a given set of automatic performance data. In the illustrated example, the automatic performance data set is organized in a so-called "event plus relative time" format, which comprises a sequence of performance event data and delta times indicative of time intervals between the performance events. Specifically, the performance event data include data indicative of types of events, such as key-on and key-off events, and data indicative of contents of the events, such as key numbers and velocities. It should be appreciated that the automatic performance data may alternatively be organized in any other conventionally-known format, such as an "event plus relative time" format where occurrence timing of each performance event is defined by an absolute time from the beginning of a music piece or a measure, or a solid format.

Figure 5:
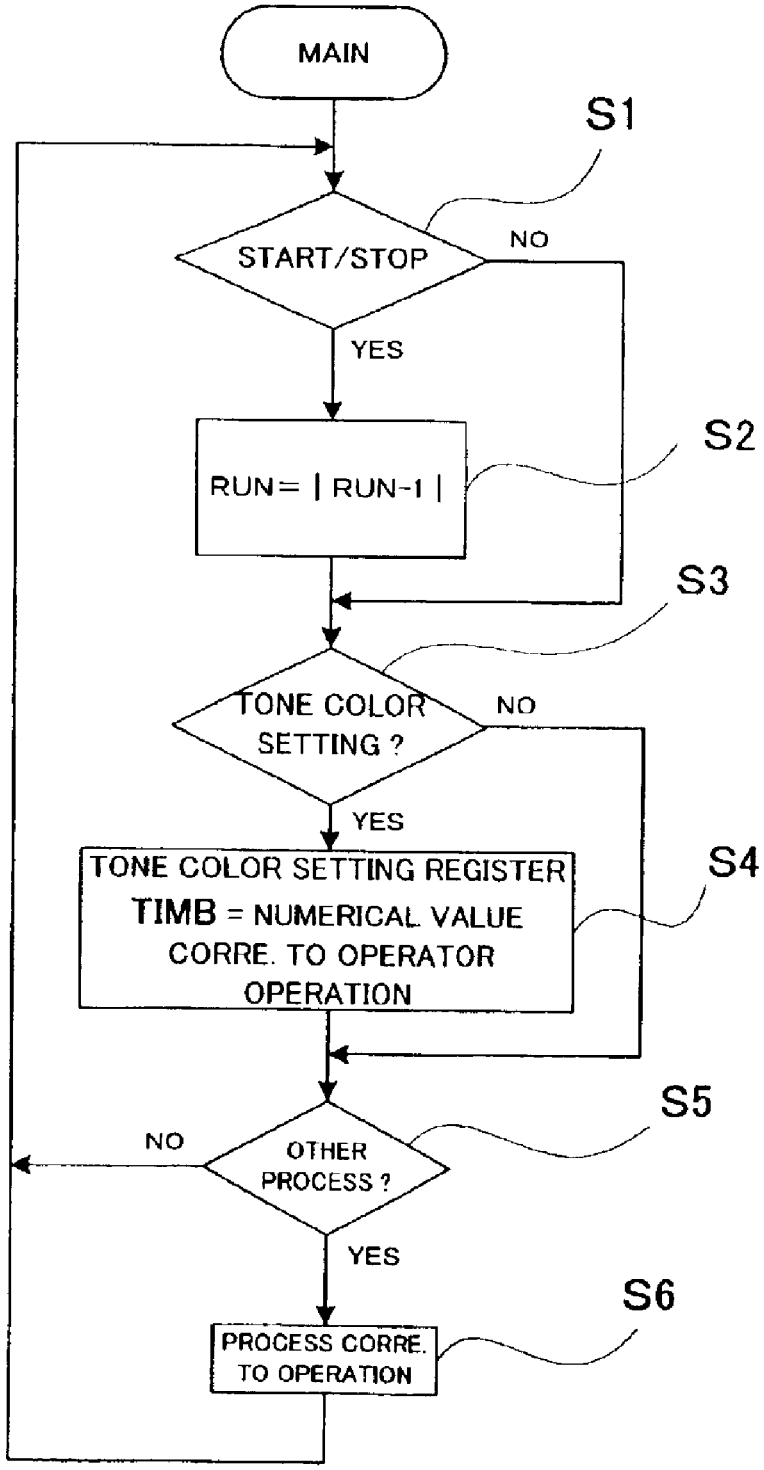
FIG. 5 is a flow chart showing a main control flow of a processing program executed by a CPU of the music box.

FIG. 5 is a flow chart showing a main flow of a processing program executed by the CPU 11 of the music box 1. The main flow is started up upon turning-on of a main power supply. First, at step S1, a determination is made as to whether or not an automatic performance start/stop switch has been operated. If the automatic performance start/stop switch has not been operated by a user (human operator), the CPU 11 proceeds to step S3. If, on the other end, the automatic performance start/stop switch has been operated by the user as determined at step S1, the value of an automatic performance flag RUN is inverted from "1" to "0" or from "0" to "1" at step S2. The automatic performance flag RUN at the value "1" indicates that an automatic performance is currently under way, in which case automatic performance reproduction processing (music piece reproduction processing) is carried out by the CPU 11 periodically executing a clock interrupt process as will be later described. At step S3, it is determined whether or not any one of the tone color setting switches has been operated by the user. If answered in the negative at step S3, the CPU 11 moves on to step S5. If, on the other hand, any one of the tone color setting switches has been operated as determined at step S3, a numerical value (i.e., tone color selecting/setting information) corresponding to the operation of the tone color setting switch (tone color selecting/setting operation) is set into a tone color setting register TIMB, at step S4. At step S5, a further determination is made as to whether any other operation has been performed by the user, e.g. for selecting a music piece data set. With an affirmative answer at step S5, a process corresponding to the user operation is carried out at step S6.

Figure 6:
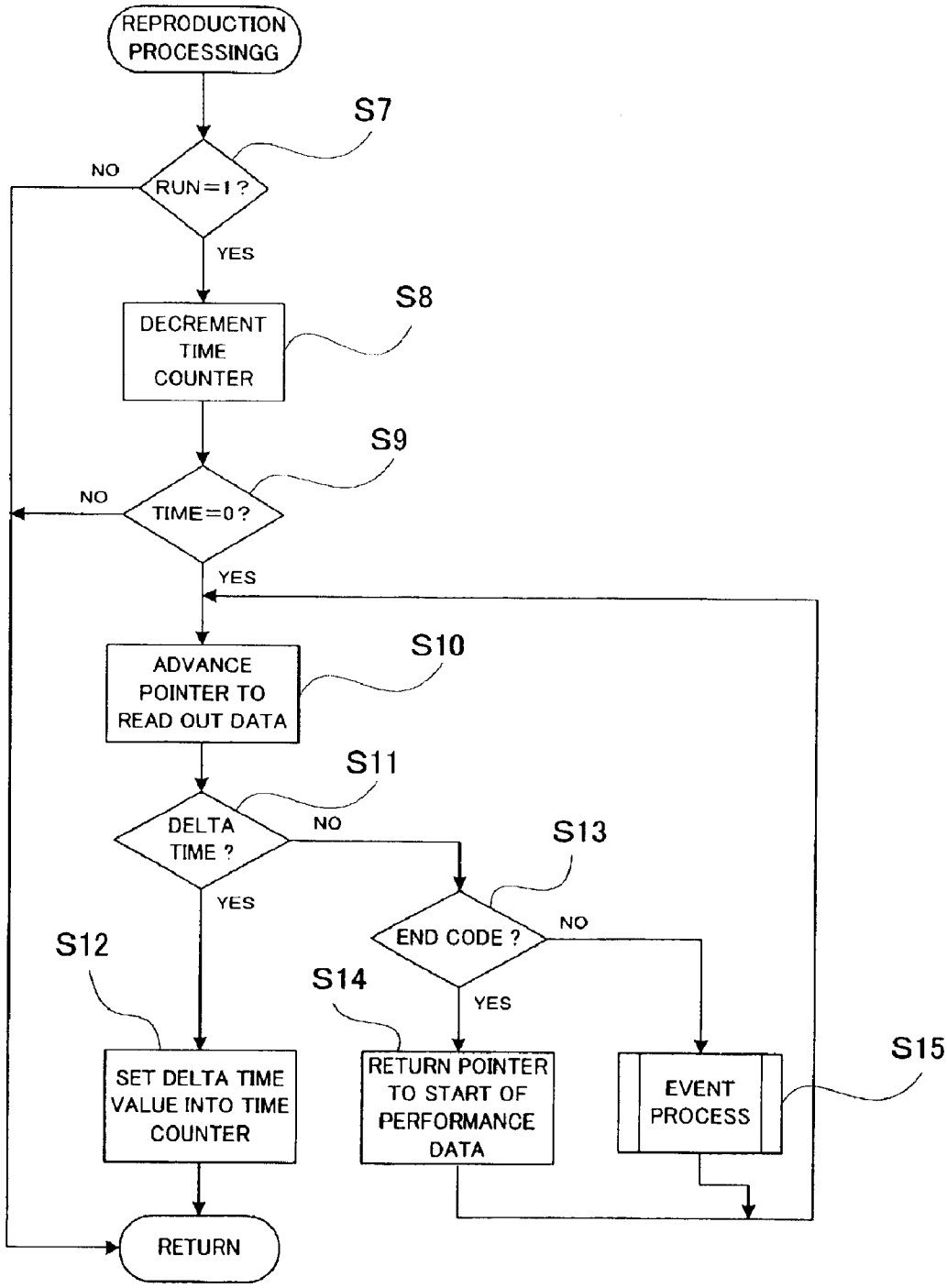
FIG. 6 is a flow chart of reproduction processing carried out in the music box.
Figure 7:
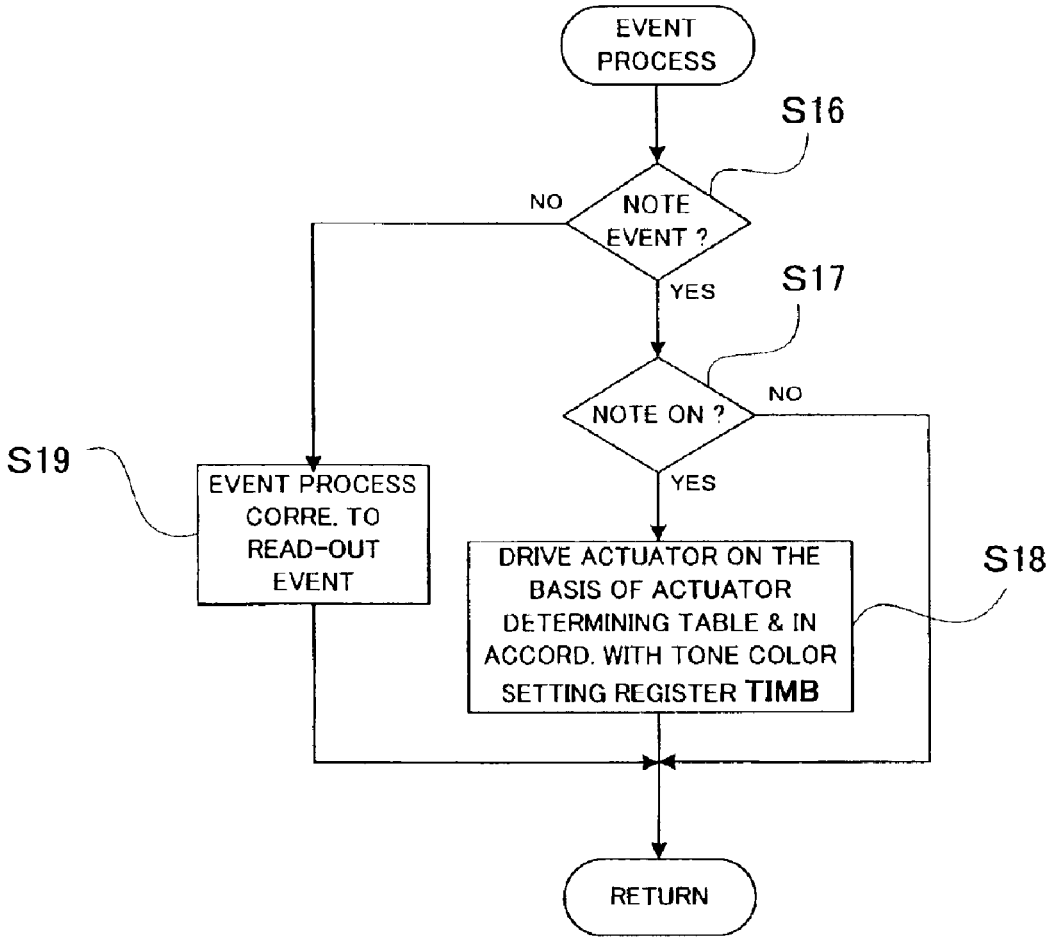
FIG. 7 is a flow chart showing an example of an event process executed during the reproduction processing of FIG. 6.

FIG. 6 is a flow chart of the automatic performance reproduction processing (music piece reproduction processing) carried out in the music box 1. The automatic performance reproduction processing is an interrupt process executed every predetermined timing on the basis of the clock pulses generated by the timer 11A, e.g., every 10 ms or every predetermined timing based on tempo clock pulses. First, at step S7, it is determined whether the automatic performance flag RUN is currently at the value "1" or not. If the automatic performance flag RUN is currently at the value "1", the automatic performance reproduction processing is continued as before; otherwise, the CPU 11 returns. Then, the count value of a TIME counter is decremented by a predetermined value, such as one, at step S8, and it is determined at step S9 whether the count value of the TIME counter has reached "0". If the count value of the TIME counter has reached "0" as determined at step S9 (YES determination), the CPU 11 proceeds to step S10; otherwise, the CPU 11 returns. At next step S10, a readout pointer is advanced, and automatic performance data (see FIG. 4) is read out from an address of a performance data memory currently designated by the readout pointer. At following step S11, it is determined whether or not the data read out at step S10 is delta data. If the read-out data is delta data (YES determination at step S11), the value of the read-out delta data is set into the TIME counter at step S12. If, on the other hand, the read-out data is not delta data (NO determination at step S11), the CPU 11 branches to step S13, where a further determination is made as to whether the data read out at step S10 is end code data. When the automatic performance has not yet reached the end of the music piece, some event data rather then end code data is read out, so that a NO determination is made at step S13 and the CPU 11 goes to step S15. At step S15, an event process is carried out on the basis of the read-out event data. Example of the event process is shown in FIG. 7. When the automatic performance has reached the end of the music piece, the end code data is read out and an YES determination is made at step S13, so that the CPU 11 moves on to step S14. At step S14, the readout pointer is brought back to the start address of the performance data of the music piece. After that, the CPU 11 reverts to the operation of step S10. Therefore, according to the automatic performance processing of the music box 1, even when the automatic performance of the selected music piece has finished, the automatic performance reproduction processing is repeated so that the same music piece is automatically performed in a repeated fashion. Thus, an automatic performance of any selected music piece can be carried out repeatedly by the music box 1 in a similar manner to conventional mechanical music boxes. Needless to say, the automatic performance can be terminated by the user operating the start/stop switch to set the automatic performance flag RUN at the "0" value.

At step S16 of the event process shown in FIG. 7, it is determined whether the data read out at step S10 is note event data (i.e., key-on or key-off event data). If the read-out data is not note event data, the CPU 11 branches to step S19, where the event process corresponding to the read-out event is carried out. If, on the other hand, the read-out data is note event data (YES determination at step S16), the CPU 11 proceeds to next step S17, where it is determined whether or not the read-out note event data is note-on (key-on) event data. With an YES determination at step S17, the CPU 11 moves on to step S18 to generate a tone. Specifically, at step S18, one of the actuators 25 is driven on the basis of the actuator determining table stored in the ROM 12 or RAM 13 and in accordance with the key number included in the read-out note-on event data and tone color selecting/setting information stored in the tone color setting register TIMB. More specifically, any one or more of the tone generation units 10*a*–10*d* are selected, and predetermined actuators 25 are driven which are provided for picking or plucking the reeds 21 of the selected tone generation units corresponding to the scale note (tone pitch) designated by the key number of the note-on event data. In this way, tones of the scale note (tone pitch) designated by the key number can be audibly generated via the selected tone generation units. If, on the other hand, the read-out data is note-off event data (NO determination at step S17), the CPU 11 returns without executing any particular process. This is because, in the music box 1, it is only necessary that each designated tone only be generated as a percussive musical tone in response to a key-on instruction.

FIG. 8 is a diagram showing an example of the actuator determining table. In the illustrated example, numbers "48", "49", "50" in "Key No." column are numerical value data specifying various tone pitches (reeds in the tone generation units), and numbers "1", "2", "3" and "4" in "TIMB (Tone Color Setting)" column are numerical value data specifying four tone colors corresponding to the four tone generation units 10*a*, 10*b*, 10*c* and 10*d*. Further, characters "A1", "A2", "A3" . . . "D1", "D2", "D3" . . . in "Solenoid No." column specify the individual actuators 25 (and hence the reeds 21) in the tone generation units 10*a*–10*d*. In the illustrated example, capital alphabetical letters A–D attached to the numerical values correspond to four tone colors, i.e. the tone generation units 10*a*–10*d*, and the numerical values represent the numbers of the actuators 25 corresponding to the reeds (key numbers). With reference to the actuator determining table, the CPU 11 specifies a solenoid No. of an actuator 25 to be driven (namely, an actuator 25 corresponding to a particular one of the tone generation units 10*a*–10*d* and a particular one of the tone pitches in the particular tone generation unit). For example, when Key No. "48" is given as a note number and numerical value "3" is set into the tone color setting register TIMB, "C1" is read out as a solenoid No. from the actuator determining table, so that the actuator 25 provided in the tone generation unit 10*c* and corresponding to the solenoid No. "C1", i.e. corresponding to the tone pitch of Key No. "48", is driven to drive the reed 21 corresponding to the tone pitch of Key No. "48" in that tone generation unit 10*c*.

Whereas the preceding paragraphs have described the case where a particular reed of a particular tone color (i.e., a particular tone generation unit) is driven in accordance with a setting of a tone color, tone color control and velocity control may be performed by changing the number of the reeds to be driven simultaneously on the basis of velocity data. Namely, the actuator determining table may be prepared such that drive control of the actuators is performed on the basis of a note event, key number, velocity data and tone color selecting/setting information. Specifically, two or more solenoid Nos., like "solenoid Nos. A1 and B1" or "solenoid Nos. A1, B1 and D1", may be set to allow two or more of the tone generation units to generate tones. In this case, because the reeds of two or more tone colors are simultaneously driven, a mixed tone color with the two or more tone colors combined can be obtained; thus, the music box 1 can provide an even wider variety of tone colors.

As another example of the tone color control and velocity control, any one of the tone generation units (e.g., tone generation unit 10*a*) may include four redundant sets of reeds 21, each of the sets being allocated to a same pitch range, on condition that four different velocity levels can be set in the music box 1; that is, in this modification, four corresponding reeds in each of the sets are allocated to a same pitch. Then, control may be performed on the basis of the velocity data such that the number of the same-pitch reeds to be simultaneously driven is switched among four different numbers of the reeds. In this case, the velocity control can be performed independently for each of the tone colors, i.e. for each of the tone generation units.

Figure 9:
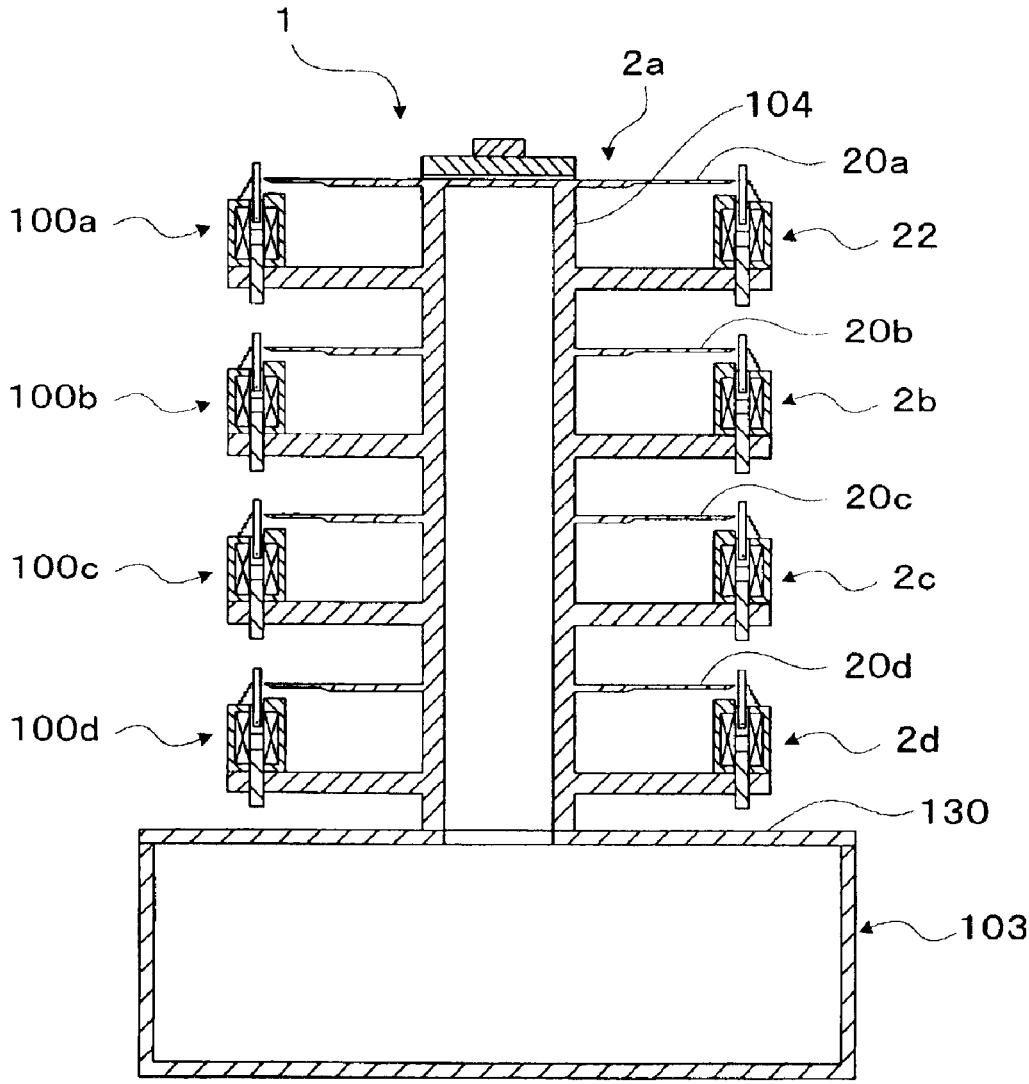
FIG. 9 is a sectional view showing a music box in accordance with another embodiment of the present invention.

In the first embodiment described above, each of the tone generation units 10*a*–10*c* includes its own resonant box 3*a*–3*d*. FIG. 9 shows a second embodiment of the present invention, where a plurality of tone generation units 100*a*–100*d* share a single resonant box 103 and where scale plates 20*a*–20*d* of the tone generation units 100*a*–100*d* are formed of different materials of different characteristics so that a wide variety of tone colors can be provided. In the second embodiment of FIG. 9, the tone generation units 100*a*–100*d* include respective tone generation mechanism 2*a*–2*d* having the respective scale plates 20*a*–20*d* and reed driving units 22, and these tone generation units 100*a*–100*d* are supported by a common central support 104. The support 104 is positioned upright on the upper surface (i.e., vibrating plate 130) of the resonant box 103, and it transmits vibrations, produced by the tone generation units 100*a*–10*d*, to the vibrating plate (sounding plate) 130. Further, the scale plate 20*a*–20*b* (constituted by reeds 21) of each of the individual tone generation units 100*a*–100*d* is formed of a material of different characteristics from the materials forming the scale plates of the other tone generation units. Because the scale plates 20*a*–20*b* are formed of different materials as above, each of the tone generation units 100*a*–100*d* can generate a tone with its peculiar tone generating characteristics, depending on the material forming its scale plate 20*a*–20*b*. Thus, the second embodiment too can generate tones with a wide variety of tone colors corresponding to the respective peculiar characteristics of the plurality of tone generation units 100*a*–10*d*, by appropriately changing the tone generation unit to be used in accordance with a desired tone color. Note that the sizes, shapes, and/or the like of the reeds 21, in addition to the materials of the scale plates 20*a*–20*d*, may be differentiated among the generation units 100*a*–100*d* to provide different tone colors and tone volumes. Further, in the second embodiment, there may be provided two or more resonant boxes 130 so that the resonant box 130 to be used can be switched as desired among the two or more resonant boxes 130.

In the first embodiment of FIG. 1 too, the scale plates (constituted by the reeds 21) of the tone generation units 10*a*–10*d* may be formed of different materials of different characteristics, as in the second embodiment of FIG. 9. In such a case, the vibrating plates 30*a*–30*d* may be formed of a same material so that each of the tone generation units 10*a*–10*d* can generate a tone with its peculiar tone generating characteristics corresponding to the material forming its scale plate 20*a*–20*d*. Alternatively, not only the scale plates 20*a*–20*d* but also the vibrating plates 30*a*–30*d* may be formed of materials differing among the tone generation units 10*a*–10*d* so that selections and changes of a variety of tone colors, corresponding to the tone generation units 10*a*–10*d* can be made more dynamically. In such a case too, the size and shape of the vibrating plates 30*a*–30*d* may be differentiated among the tone generation units 10*a*–10*d* to achieve a variety of tone volumes.

Figure 10A:
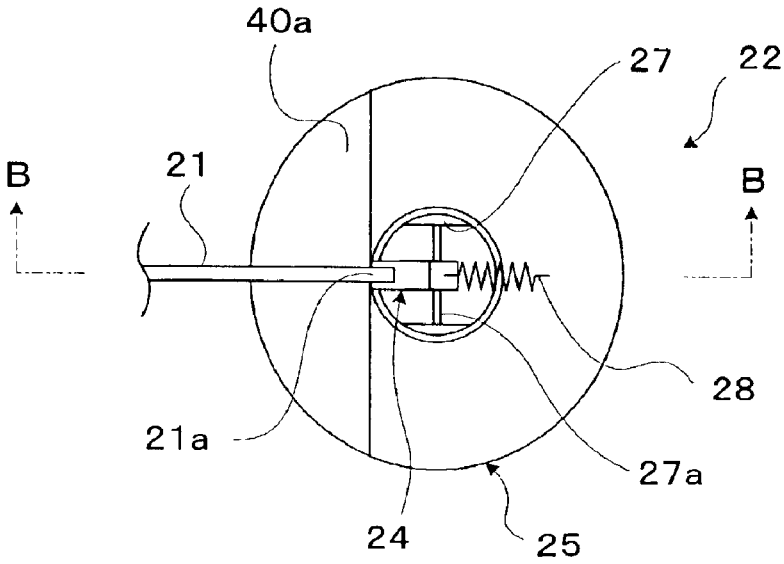
FIG. 10A is a plan view of a reed driving unit.
Figure 10B:
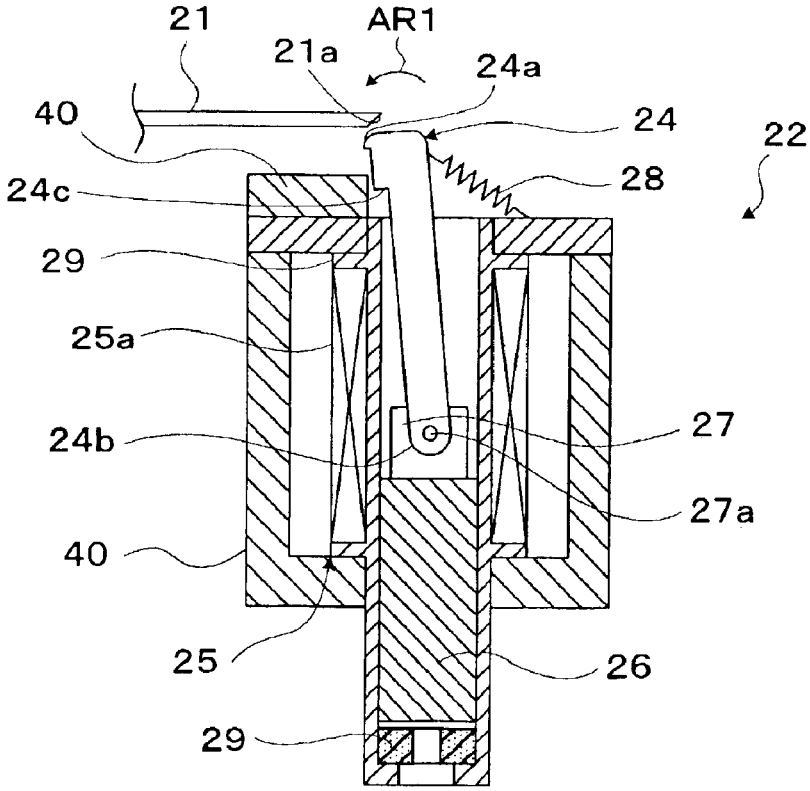
FIG. 10B is a vertical sectional view taken along the B—B line of FIG. 10A.
Figure 11A:
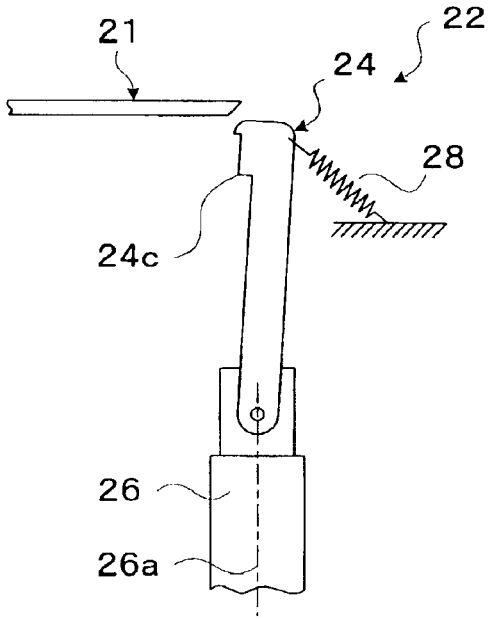
FIGS. 11A–11C are side views explanatory of picking or plucking operation of a pick member.
Figure 11B:
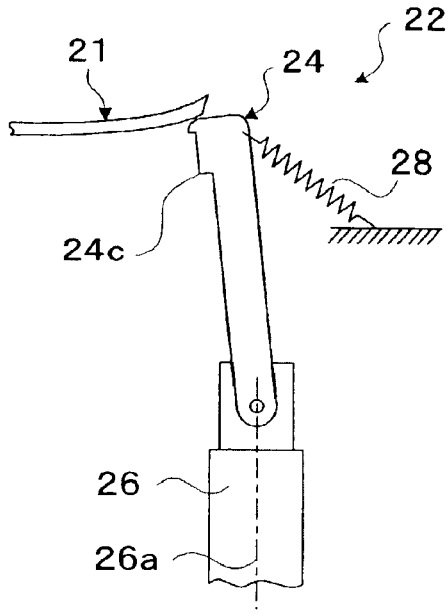
Figure 11C:
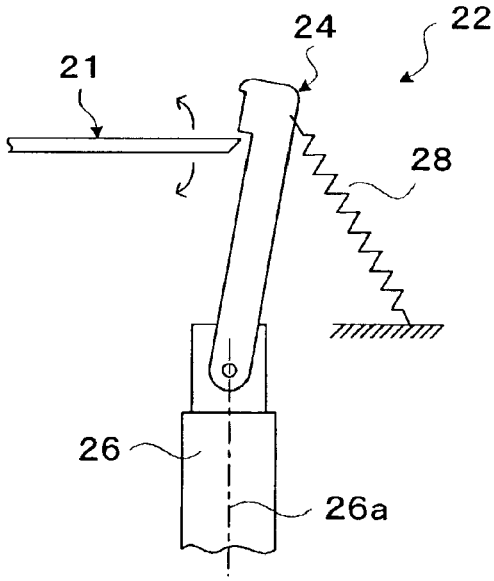

Next, a description will be given about a specific example of the reed driving unit 22, with reference to FIGS. 10A–11C. FIG. 10A is a plan view of the reed driving unit 22, and FIG. 10B is a vertical sectional view taken along the B—B line of FIG. 10A. FIGS. 11A–11C are side views explanatory of picking or plucking operation of the pick member 24.

The reed driving unit 22 are similar in structure to one another, and one of the reed driving unit 22 is hereinafter described in detail with reference to FIGS. 10A and 10B. The PWM driver 17 shown in FIG. 3 is connected to the plural actuators 25 of the reed driving unit 22 in parallel, and selectively supplies driving current to the actuators 25 of the reed driving unit 22.

The reed driving unit 22 is broken down into the solenoid-operated actuator 25, the pick member 24 and a spring 28. The solenoid-operated actuator 25 is supported by a casing (outer yoke) 40 and the pick member 24 is mounted on the solenoid-operated actuator 25. The spring 28 is connected between the pick member 24 and the casing 40, and urges the pick member 24 outwardly.

A coil 25*a*, a yoke (inner yoke or bobbin) 29, a cushion sheet 29*a* and a plunger 26 form in combination the solenoid-operated actuator 25. The yoke 29 has a cylindrical configuration, and the cushion sheet 29*a* is provided at the bottom of the inner space of the yoke 29. The coil 25*a* is wound on the outer surface of the yoke 29, and the plunger 26 is slidably received in the inner space of the yoke 29. The casing 40 has an inner portion slightly projecting, and forms an offset yoke structure. When current flows through the coil 25*a*, the current creates a magnetic field across the yoke 29. The yoke 29 and casing 40 offer a magnetic path to the electric field. The casing 40 has the inner portion projecting from the outer portion so that the magnetic field is asymmetrically developed. For this reason, the pick member 24 is urged inwardly as indicated by arrow AR1, and the plunger 26 upwardly projects form the yoke 29. The inwardly inclined pick member 24 is brought into contact with the tip 21*a* of the associated reed 21. If the magnetic field is removed, then the plunger 26 is retracted into the yoke 29, and is landed on the cushion sheet 29*a*. The cushion sheet 29*a* prevents the plunger 26 from dropping out.

The plunger 26 is formed with a pair of wall portions 27. The wall portions 27 are upright on the upper surface of the plunger 26, and are spaced from each other in parallel to the associated reed 21. A pin 27*a* is fixed at both ends thereof to the wall portions 27 in such a manner as to be perpendicular to the longitudinal direction of the associated reed 21, and the pick member 24 is rotatably connected at the lower portion 24*a* thereof to the pin 27*a*. The pick member 24 is a thin narrow plate of soft magnetic material, and is rotatable about the pin 27*a*. The extension line of the centerline of the associated reed 21 is on the trajectory of the pick member 24. The pick member 24 has an upper end portion 24*a*, which is wider than the lower end portion 24*b* so that a step 24*c* is formed at the boundary between the upper end portion 24*a* and the lower end portion 24*b*. On the other hand, the tip 21*a* of the reed 21 is tapered. While the plunger 26 is projecting from the yoke 29, the upper end portion 24*a* is brought into contact with the tapered tip 21*a*, and makes the reed 21 warped.

The spring 28 is connected at one end thereof to the upper portion of the pick member 24 and at the other end thereof to the upper surface of the casing 40. While the plunger 26 is resting in the yoke 29, the spring 28 is in its free length, and any elastic force is not exerted on the pick member 24. The spring 28 increases the elastic force together with the distance between the pick member 24 and the casing 40, and urges the pick member 24 outwardly. As described hereinbefore, when the current starts to flow through the coil 25*a*, the magnetic force makes the pick member 24 inwardly inclined. The magnetic force is larger than the elastic force of the spring 28 in the initial stage where the pick member 24 warps the reed 21. When the step 24*c* exceeds the upper end of the casing 40, the space between the pick member 24 and the coil 25*a* is so wide that the magnetic force is equalized to the elastic force. The plunger 26 further projects upwardly, and the step 24*c* is spaced from the upper end 40*a*. Then, the elastic force becomes larger than the magnetic force, and the pick member 24 escapes from the reed 21, and the reed 21 vibrates for generating the tone. While the plunger 26 is being retracted into the yoke 29, the spring 28 keeps the pick member 24 inclined outwardly. Thus, the spring 28 prevents the pick member 24 from chattering.

The reed driving unit 22 behaves for plucking the associated reed 21 as follows. The controller is assumed to remove the magnetic field from the reed driving unit 22. The pick member 24 is outwardly inclined with respect to the centerline 26*a* of the plunger 26, and the rounded upper end portion 24*a* is spaced from the tapered tip 21*a* as shown in FIG. 11A.

When the current flows through the coil 25*a*, the pick member 24 is inwardly inclined, and the plunger 26 starts to upwardly project against the elastic force of the spring 28. The plunger 26 is brought into contact with the tapered tip 21*a*, and pushes the reed 21 upwardly. Although the expanded spring 28 increases the elastic force exerted on the pick member 24, the magnetic force is still larger than the elastic force so that the pick member 24 makes the reed 21 warped as shown in FIG. 11B.

The plunger 26 further projects form the yoke 29, and the pick member 24 becomes far from the coil 25*a*. When the magnetic force becomes smaller than the elastic force, the spring 28 pulls the pick member 24 outwardly, and the pick member 24 escapes from the reed 21, as shown in FIG. 11C. Then, the reed 21 starts the vibrations, and generates the tone. The other reed driving units 22 behave along the above-described sequence so as to pluck the associated reeds 21.

In the above-described first and second embodiments, the scale plates may be of any other suitable type than the type illustrated in FIG. 2, such as a comb type having a plurality of vibrating pieces arranged like a row of comb teeth. Further, the structures of the supports 4*a*–4*d* and abutting portions of the supports 4*a*–4*d* against the respective resonant boxes 3*a*–3*d* (vibrating plates 30*a*–30*d*) may be modified to change characteristics of the vibrating plates 30*a*–30*d*. Further, whereas the embodiments have been described as providing the resonant boxes 3*a*–3*d* (vibrating plates 30*a*–30*d*) at the lower end of the respective tone generation mechanisms 2*a*–2*d*, the vibrating plates may be provided at both of the upper and lower ends of the respective tone generation mechanisms 2*a*–2*d*.

Furthermore, whereas the embodiments have been described above in relation to the music box including scale plates (tone generators) each having a plurality of vibrating pieces as tone generating elements, it should be appreciated the application of the present invention is not limited to performance devices having vibrating pieces to be picked or plucked for performance; the basic principles of the present invention is also applicable to performance devices, such as harps, having strings to be picked or plucked, and performance devices, such as carillons and xylophones, having sounding bars to be struck for performance.

Moreover, some of the reeds in any one of the tone generation units made of the same material may be formed into different shapes and sizes, so that there can be generated a tone having been controlled in accordance with not only a pitch but also velocity of the performance data.

Furthermore, the performance data to be used in the above-described reproduction processing may be other than data read into the RAM 13, such as MIDI performance data. For example, where MIDI performance data are to be generated with a plurality of tone colors in response to keyboard operation of a MIDI keyboard musical instrument or the like, a plurality of tone colors may be set in advance by dividing the keyboard into a plurality of key ranges so that a tone of a desired tone color is generated by a reed corresponding to the key range assigned to the desired tone color. Further, the performance device of the present invention may be arranged to execute a music piece performance on the basis of performance data supplied in real time via a communication line. Furthermore, in the present invention, desired tone colors may be set on the basis of tone color selecting/setting information included in automatic performance data, in addition to being set through setting operation via the tone color setting operators.

In summary, the present invention is characterized in that the resonant boxes are formed of different materials having different characteristic. Thus, by selecting an appropriate one of the tone generation units so that the resonant box corresponding to a tone color set by tone color setting information is used, there can be generated a tone with peculiar tone generating characteristics corresponding to the material of the resonant box used. As a result, the present invention can generate tones with a wide variety of tone colors corresponding to the different characteristics of the resonant boxes. The present invention is further characterized in that the tone generation units are formed of different materials having different characteristics. Thus, by selecting an appropriate one of the tone generation units on the basis of tone color setting information, there can be generated a tone with peculiar tone generating characteristics corresponding to the material of the selected tone generation unit. As a result, the present invention can generate tones with a wide variety of tone colors corresponding to the different characteristics of the tone generation units.

The present invention relates to the subject matter of Japanese Patent Application No. 2002-099831 filed on Apr. 2, 2002, the disclosure of which is expressly incorporated herein by reference in its entirety.

What is claimed is:

1. A performance device comprising:

a plurality of tone generation units, each of said tone generation units including a plurality of tone generating elements corresponding to a plurality of tone pitches;

a plurality of resonant boxes provided in corresponding relation to said tone generation units, each of said resonant boxes being formed of a material having a characteristic different from materials forming the other resonant boxes;

a drive mechanism that mechanically drives and thereby vibrates said tone generating elements; and a control section that determines any of the tone generating elements to be driven for tone generation on the basis of tone pitch designating information and tone color setting information and controls said drive mechanism to drive the determined tone generating element.

2. A performance device as claimed in claim 1 wherein each of said resonant boxes has a box-shaped resonating space.

3. A performance device as claimed in claim 1 wherein each of said resonant boxes includes a vibrating plate that vibrates in response to mechanical vibrations of a corresponding one of said tone generation units.

4. A performance device as claimed in claim 1 wherein said control section changes a total number of the tone generating elements to be driven simultaneously and thereby changes a tone color of a tone to be generated.

5. A performance device as claimed in claim 1 which further comprises an operator unit operable by a user to set a desired tone color, and where the tone color setting information is given to said control section in accordance with tone color setting operation via said operator unit.

6. A performance device as claimed in claim 1 which further comprises a performance information generation unit that generates performance information to be used for reproducing a desired music piece, and wherein the tone color setting information included in the performance information generated by said performance information generation unit is given to said control section.

7. A performance device comprising:

a plurality of tone generation units, each of said tone generation units including a plurality of tone generating elements corresponding to a plurality of tone pitches, said tone generating elements in each of said tone generation units being formed of a material having a characteristic different from materials forming said tone generating elements of the other tone generation units;

a resonant box that resonantly vibrates in response to vibrations produced on said tone generation units;

a drive mechanism that mechanically drives and thereby vibrates said tone generating elements; and a control section that determines any of the tone generating elements to be driven from among the plurality of tone generation units on the basis of tone pitch designating information and tone color setting information and controls said drive mechanism to drive the determined tone generating element.

* * * * *